US010634164B2

(12) United States Patent
Rodrigues

(10) Patent No.: US 10,634,164 B2
(45) Date of Patent: Apr. 28, 2020

(54) FLOW MACHINE, AND FLOW GUIDING ELEMENT FOR A FLOW MACHINE

(71) Applicant: SULZER MANAGEMENT AG, Winterthur (CH)

(72) Inventor: Arnaldo Rodrigues, Winterthur (CH)

(73) Assignee: SULZER MANAGEMENT AG, Winterthur (CH)

( * ) Notice: Subject to any disclaimer, the term of this patent is extended or adjusted under 35 U.S.C. 154(b) by 229 days.

(21) Appl. No.: 14/761,846

(22) PCT Filed: Jan. 22, 2014

(86) PCT No.: PCT/EP2014/051176
§ 371 (c)(1),
(2) Date: Jul. 17, 2015

(87) PCT Pub. No.: WO2014/122016
PCT Pub. Date: Aug. 14, 2014

(65) Prior Publication Data

US 2015/0361990 A1 Dec. 17, 2015

(30) Foreign Application Priority Data

Feb. 8, 2013 (EP) ..... 13154649

(51) Int. Cl.
*F04D 29/42* (2006.01)
*F04D 29/44* (2006.01)
(Continued)

(52) U.S. Cl.
CPC ..... *F04D 29/445* (2013.01); *F01D 5/06* (2013.01); *F01D 9/02* (2013.01); *F01D 25/24* (2013.01);
(Continued)

(58) Field of Classification Search
CPC ..... F04D 29/445; F04D 29/44; F04D 29/448; F04D 29/441; F04D 29/422
(Continued)

(56) References Cited

U.S. PATENT DOCUMENTS 705,347 A * 7/1902 Harris ..... F04D 29/2255 277/358
1,235,559 A * 8/1917 Laval ..... F04D 1/006 415/102
(Continued)

FOREIGN PATENT DOCUMENTS

CN 2487900 Y 4/2002
EP 1386764 A2 2/2004
WO WO 2009024741 A1 * 2/2009 ..... F02B 37/225

OTHER PUBLICATIONS

International Search Report in PCT/EP2014/051176 dated Feb. 21, 2014.

*Primary Examiner* — Deming Wan
(74) *Attorney, Agent, or Firm* — Global IP Counselors, LLP

(57) ABSTRACT

A flow machine includes a rotor rotatably arranged about an axis of rotation in a rotor space of a housing. For energy exchange between a flow energy of a flowing fluid and a mechanical rotational energy, the fluid can be supplied to the housing of the flow machine in so as to bring the fluid into flowing contact with the rotor for the energy exchange and can be led out of the housing of the flow machine. A flow guiding element running about the axis of rotation in a peripheral direction of the rotor is disposed in the rotor space between an inner wall of the rotor space and the rotor in such a way that the rotor is surrounded by the flow guiding element over a predeterminable axial width.

21 Claims, 11 Drawing Sheets

(51) Int. Cl.

| | |
|---|---|
| ***F01D 5/06*** | (2006.01) |
| ***F01D 9/02*** | (2006.01) |
| ***F01D 25/24*** | (2006.01) |
| ***F04D 1/00*** | (2006.01) |
| ***F04D 1/06*** | (2006.01) |
| ***F04D 17/10*** | (2006.01) |
| ***F04D 17/12*** | (2006.01) |
| ***F04D 29/22*** | (2006.01) |
| ***F04D 29/28*** | (2006.01) |

(52) U.S. Cl.
CPC ..... *F04D 1/006* (2013.01); *F04D 1/06* (2013.01); *F04D 17/105* (2013.01); *F04D 17/12* (2013.01); *F04D 29/22* (2013.01); *F04D 29/28* (2013.01); *F04D 29/426* (2013.01); *F04D 29/441* (2013.01)

(58) Field of Classification Search
USPC ..... 415/208.2, 208.3, 204, 206, 184–186, 415/187, 211.1, 211.2
See application file for complete search history.

(56) References Cited

U.S. PATENT DOCUMENTS

| | | | | | |
|---|---|---|---|---|---|
| 2,143,100 | A * | 1/1939 | Anderson | F04D 29/464 | 415/155 |
| 2,770,009 | A * | 11/1956 | Rogal | B29C 47/8835 | 415/121.3 |
| 3,071,313 | A | 1/1963 | Weisel | | |
| 3,367,570 | A * | 2/1968 | Horst | F23C 99/00 | 236/12.1 |
| 5,399,068 | A * | 3/1995 | Park | F04D 29/4226 | 415/204 |
| 5,601,400 | A * | 2/1997 | Kondo | F04D 29/4226 | 415/119 |
| 6,146,095 | A * | 11/2000 | Bross | F04D 29/445 | 415/163 |
| 7,883,312 | B2 * | 2/2011 | Eguchi | F04D 29/162 | 415/119 |
| 8,616,616 | B2 * | 12/2013 | van Raemdonck | B62D 35/008 | 296/180.4 |
| 2008/0279681 | A1 | 11/2008 | Eguchi et al. | | |
| 2012/0222643 | A1 * | 9/2012 | Jasnie | F02M 35/1211 | 123/184.57 |

* cited by examiner

FLOW MACHINE, AND FLOW GUIDING ELEMENT FOR A FLOW MACHINE

CROSS-REFERENCE TO RELATED APPLICATIONS

This application is a U.S. National stage application of International Application No. PCT/EP2014/051176, filed Jan. 22, 2014, which claims priority to EP Application No. 13154649.1 filed on Feb. 8, 2013, the contents of each of which is hereby incorporated herein by reference.

BACKGROUND

Field of the Invention

The invention relates to a flow machine, in particular to a pump or to a turbine, for the exchange of energy between a flow energy of a flowing fluid and a mechanical rotational energy, as well as to a flow guiding element for such a flow machine.

Background Information

Like in all fields of industrial technology higher demands are made with respect to the ideal operation, to high reliability and in particular also to low energy consumption. A flow machine in the framework of this application should, on the one hand, in particular, but not exclusively, be understood as a pump as known per se for the pumping of fluids, such as e.g. water, oil, crude oil, in particular also multiphase mixtures which can include liquid and/or gas-like and/or solid components or also other machines for the conveying and/or the pumping of arbitrary fluids. On the other hand, also any other kind of turbine for subjecting a fluid to a manipulation by a turbine can be understood as a flow machine according to the frame work of this application. In particular, but not only turbines for the recovery and/or the conversion of flow energy which is inherent in a flowing fluid.

Prominent examples for this are, amongst other things, turbines, such as those that have been used for a very long time, for example, in pump storage power plants for the recovery of potential storage energy in a manner known per se. As the person of ordinary skill in the art knows, excess electrical energy present in such applications is thereby converted into storable potential energy by means of a pump in such a manner that a pump can be driven via an electromotor by means of the excess electrical energy, wherein the pump pumps water, for example, from a lower lying river into a higher lying water reservoir, such that at least the largest part of the excess electrical energy is stored in the higher lying water reservoir in the form of potential energy of the water. When the thus stored electrical energy is then required again it is resupplied to the river from the higher lying reservoir via a turbine. In this connection, the turbine is driven by the water flowing downwardly into the river which turbine in turn again drives an electrical generator, such that the electrical energy can again be recovered.

SUMMARY

In this connection, the invention is not restricted to a certain pump type or turbine type. For example, but not exclusively, the invention also relates to double flow machines which are to be understood in the frame work of this application as such flow machines whose essential feature, in the case of pumps which are then also frequently referred to as double suction pumps, consists therein that the fluid is supplied to the rotor of the pump from both sides and substantially symmetrically from both sides. By way of analogy for double flow turbines the fluid is guided away from the rotor of the turbine at both sides and substantially symmetrically from both sides. In this connection, double rotors are frequently also used which have two parallel sets of rotor vanes which can be separated from one another in an axial direction by a separating element, but do not have to be. An enormous advantage of such double flow machines consists therein that the axial feed acting on the rotor and on the rotor axis and in this manner on the axial bearings is substantially compensated by the double sided symmetrical to flow and run off of the fluid and does not have to be compensated in the bearing by measures demanding in effort and cost.

It is naturally understood that also any arbitrary other type of pump or turbine, e.g. multi-stage pumps or turbines each having more than one rotor etc. is to be understood as a flow machine in the framework of this application.

A pump type frequently used in the field of pumping is, for example, a rotary pump frequently also referred to as a centrifugal pump. A simple embodiment of this pump type known from the prior art is schematically illustrated in a very simplified manner by FIG. 1.

At this point it should be noted that the reference numerals which relate to features of examples known from the prior art are provided with an inverted coma, as is the case for the known example in accordance with FIG. 1. In contrast to this reference numerals, which relate to features of embodiments in accordance with the invention, do not have an inverted coma, as is the case for the embodiments illustrated in FIG. 1*a* to FIG. 3*c*.

Moreover, albeit the fact that the invention in no way exclusively relates to rotary pumps and/or centrifugal pumps the problems existing in the state of the art, which are solved for the first time by the present invention, will be exemplary discussed with reference to the rotary pump in accordance with FIG. 1. The person of ordinary skill in the art readily understands that the analog problems present in the state of the art can principally also then occur for a pump, e.g. for a rotary pump in accordance with FIG. 1, when it is operated as a turbine, this means when the fluid is supplied to the flow machine in the reverse direction. In this respect the following illustration of the problems known from the state of the art are not only true for the pump in accordance with FIG. 1, but are also true in an analog manner also for other pump types and also for other types of flow machines, this also means in principle for turbines.

The known rotary pump of FIG. 1, which is referred to in the following in total with the reference numeral 1', works in a manner known per se in accordance with a very simple general principle. The fluid F', e.g. water, is guided to the rotor 2' in the region of the rotor hub via an inlet passage of the flow machine 1', not explicitly illustrated for reasons of clarity in the present example, this means in the present example is guided to the rotary pump 1'. The rotor 2' is in this connection rotatably arranged about the axis of rotation A' in a rotor space 3' of the housing 4' of the flow machine 1'.

In this connection the rotor 2' of the rotary pump 1' is driven via an axis of rotation A' by an electromotor, likewise not illustrated, in such a manner that the fluid F' is flung radially outwardly through the fast rotation of the rotor 2' by means of the centrifugal force towards the outer edge of the rotor 2' and in the direction towards the inner wall 31' of the rotor space 3', such that at least a part of the mechanical rotational energy of the rotor 2' is transferred to the fluid F', partially in the form of kinetical flow energy and partially as pressure energy. Via the outlet passage 9', the fluid F' then exits the pump 1' via the outlet 91' at an increased pressure and/or with an increased flow energy and is supplied to a further processing and/or use.

The person of ordinary skill in the art readily understands that the rotary pump 1' can in principle also be used as a turbine in that the fluid is simply supplied in the reverse direction via the outlet 91' of the flow machine 1' of FIG. 1 at a predefinable pressure and/or with a predefinable flow energy via the rotor space 3' from the outside via the outer edge to the rotor 2' and is guided away again from the flow machine 1' via the rotor hub and the non-illustrated inlet passage.

This means, from a purely functional aspect, the connection of the flow machine operated in the pumping mode as an outlet becomes the inlet for the fluid during the turbine operation such that functionally a turbine results out of the pump through a reversal of the fluid flow, by which reversal the flow energy of the through flowing fluid can be converted into rotational energy on flowing through the rotor which rotational energy can then be converted into electrical energy e.g. via a connected electrical generator. In this connection, the person of ordinary skill in the art knows the measures which possibly have to be taken on a conversion from the pumping operation to a turbine operation or vice versa, for example, the adjustment of the rotor vanes of the rotor or other measures known for a long time.

The problem well-known known from the prior art of a flow machine in accordance with the exemplary FIG. 1, or also of other flow machines known to a person of ordinary skill in the art, regardless of whether these are now pumps or turbines, substantially results from the interaction between the rotor 2' rotating in the operating stage, the flowing fluid F' and the inner wall 31' of the rotor space 3' of the housing 4'.

Due to the fact that for reasons of construction the rotor 2' is not rotationally symmetrically surrounded by the inner wall 31', a radial force oriented towards and/or away from the rotor 2' in the direction towards the axis of rotation A' in the peripheral direction U' is not uniform.

This deficiency can generally not be compensated thereby that the rotor space 3' is formed e.g. rotationally symmetric about the axis of rotation A', this means about the rotor 2'.

As is well known to the person of ordinary skill in the art, the increasing constriction and/or extension of the free space in the peripheral direction U' between the rotor 2' and the inner wall 31' illustrated in FIG. 1 is generally compulsory necessary for technical reasons in order to even obtain a sufficient pump performance during the pumping operation or a sufficient turbine performance during the turbine operation.

The consequence is that, for example, there where the rotor 2' is neighbored closer to the inner wall 31', the forces acting on the rotor 2' in the operating state are larger, when viewed in the peripheral direction U' than at a different position, where the rotor 2' has a larger spacing with regard to the inner wall 31'. This fact is both true for a pump and also for a turbine in the operating state. The force acting on the rotor 2' in the operating state increases correspondingly in the peripheral direction U', when the spacing between the rotor 2' and the inner wall 31' decreases.

In this connection the region in the vicinity of the inlet lip L' is particularly critical, there where the spacing between the rotor 2' and the inner wall 31' is generally smallest and strong interactions and/or repercussions between the fluid F' exiting from the rotor 2' and the fluid F' flowing out via the outlet passage 9' take place. The person of ordinary skill in the art knows that analog strong interactions emerge also for a turbine in the region of the lip L'. In this connection, not only static forces acting on the rotor 2' in the peripheral direction U' arise at various strengths, but also more or less periodic pulsed pressure forces acting at the rotor 2' and/or at the inner wall 31' arise which additionally have damaging effects, such as swells or turbulences in the fluid F', periodically changeable damaging forces acting at the bearing of the rotor etc.

This not only leads to the most different static and dynamic force effects acting at the rotor 2' in the peripheral direction U' and therefore at the rotor axis and at the bearings of the rotor axis which are thereby permanently damaged, but due to the arising swells and turbulences in the fluid F' strong inner friction losses in the fluid F' and/or unnecessary friction losses on the interaction of the flowing swelled fluid F' with the inner wall 31' of the rotor space 3' arise, whereby the efficiency of such flow machines 1' can be significantly reduced and therefore the electrical energy consumption of the pump operation can massively increase for pumps. Alternatively in the case of a turbine the efficiency of the recoverable energy can be massively reduced which are each both no longer acceptable for economic reasons and also for ecologically reasons in this day and age.

For this reason it is an object of the invention to provide a flow machine in which the static and dynamic force effects at the rotor are significantly reduced in comparison to the state of the art and at the same time to massively reduce the negative effects and turbulences in the fluid arising in the rotor space, in particular also in the region of the inlet lip, such that, on the one hand, a smaller wear at the rotor, rotor axis and the bearings of the rotor axis is achieved; and, on the other hand, the energy efficiency of the flow machine is significantly increased, such that longer periods of operations and longer periods between maintenance become possible and thus costs can be saved, and at the same time an as ecological operation as possible is ensured.

The invention relates to a flow machine, in particular to a pump or a turbine, including a rotor which is rotatably arranged about an axis of rotation in a rotor space of a housing of the flow machine. In this connection, for energy exchange between a flow energy of a flowing fluid and a mechanical rotational energy, the fluid can be supplied to the housing of the flow machine in such a way that the fluid can be brought into flowing contact with the rotor for the energy exchange and can be led out of a housing of the flow machine again. In accordance with the invention a flow guiding element running about the axis of rotation in a peripheral direction of the rotor is provided in the rotor space between an inner wall of the rotor space and the rotor in such way that the rotor is surrounded by the flow guiding element over predetermined axial width.

It is thus essential for the present invention that in contrast to the prior art a flow guiding element running about the axis of rotation in a peripheral direction of the rotor is provided in the rotor space between an inner wall of the rotor space and the rotor in such a way that the rotor is surrounded by the flow guiding element over a predetermined axial width.

This means that, in the simplest case, the flow guiding element in accordance with the invention is a ring having a rectangular or quadratic ring cross-section, and is particularly preferably concentrically arranged with respect to the axis of rotation around the rotor of the flow guiding element. In this connection, it is particularly important that the rotor of the flow machine is surrounded by the flow guiding element in accordance with the invention, in particular also in the region of the inlet lip, where in the state of the art the arising turbulences in the fluid and/or the arising forces are frequently particularly strong and are subjected to particularly strong fluctuations in time.

At this point, it should be noted that the term inlet lip is used in the same manner both from a construction point of view and from a geometric point of view, both for turbines and also for pumps.

By means of the invention it was thus achieved for the first time, on the one hand, to maintain the constriction and/or expansion of the free space between the rotor and the inner wall running in the peripheral direction generally compulsory required for technical reasons and, on the other hand, to significantly reduce the static and dynamic force effects at the rotor in comparison to the state of the art at the same time. Moreover, to simultaneously massively reduce the negative effects, such as swells and turbulences in the fluid arising in the rotor space, in particular also in the region of the inlet lip, such that, on the one hand, a lesser wear at the rotor, the rotor axis and the bearing of the rotor axis is achieved. And, on the other hand, such that the energy efficiency of the flow machine is significantly increased, in such a way that by means of the invention longer operating times and longer intervals between maintenance become possible, whereby significant costs can be saved at the same time and an as ecological operation is possible is ensured.

The flow guiding element in accordance with the invention namely has the consequence that, for example, also there where the rotor is neighboring closer to the inner wall, the forces acting on the rotor in the operating state are substantially not larger than when viewed in the peripheral direction at a different position, where the rotor has a larger spacing with respect to the inner wall. Expressed differently, the forces acting at the rotor are distributed rather more uniformly and the forces acting at the rotor of the flow machine in the operating state thus do not increase massively in the corresponding peripheral direction in which the spacing between the rotor and the inner wall decreases through the flow guiding element in accordance with the invention.

Since the flow guiding element in accordance with the invention surrounds the rotor also in the region of the inlet lip, where the spacing between rotor and inner wall generally is smallest and therefore particularly strong interactions and/or reactions in the flowing fluid and/or between the flowing fluid and the inner wall of the rotor space arise in the prior art, the forces also acting at the rotor there, as well as the turbulences and the negative interactions between fluid and the inner wall and/or between the fluid and the rotor are significantly reduced. The reduction of the damaging interactions in this connection not only relate to the static differently strong forces acting at the rotor in the peripheral direction, but also relate to the more or less periodically pulsing pressure forces acting at the rotor.

For an embodiment particularly preferred in practice of a flow machine in accordance with the invention the flow guiding element, as already mentioned, is designed in the form of a cylindrical flow ring of a predefinable width which preferably, but not necessarily approximately corresponds to the axial width of the rotor. In this connection the flow guiding element, more specifically, the cylindrical flow ring is formed at a predefinable radial spacing from the axis of rotation in the peripheral direction around the rotor.

Particularly preferably a cross-section of the flow guiding element is rectangular, at least section-wise, and/or is of droplet shape at least section-wise in this connection, with the width of the flow guiding element being able to be advantageously reduced in the radial direction towards the rotor, whereby a flow around of the flow guiding element can possibly be improved and/or optimized. Thus it is possible that, in the case of a pump, the width of the flow guiding element reduces in the radial direction towards the rotor, while in the case of a turbine the width of the flow guiding element reduces in the radial direction away from the rotor. It is naturally understood that the width of the flow guiding element in certain cases can also simultaneously reduce in both radial directions, this means in the radial direction towards the rotor and away from the rotor, which can be particularly advantageous for a flow machine which is used both as a pump and also as a turbine, which, however, depending on the type of construction, can be advantageous for the flow machine operated only as a pump or only as a turbine.

In this connection it is also possible that the flow guiding element is not formed as a compact ring, but rather that one or more through flow openings of predefinable equal or different size are provided at the flow guiding element which openings can e.g. extend substantially in the radial direction and/or in the axial direction and/or transverse to the radial direction, whereby, depending on the specific type of construction of the flow machine, the flow of the fluid can be optimized and the formation of damaging swells and turbulences in the fluid can further be reduced.

It is also possible in practice that a marginal surface of the flow guiding element extending in the axial direction has a structured surface, in particular a periodically structured surface extending in the peripheral direction, wherein naturally also in analogy a marginal surface of the flow guiding element extending in the radial direction can have a structured surface, in particular a periodically structured surface extending in the peripheral direction, whereby likewise the flow of the fluid in the flow machine and/or the formation of damaging swells and turbulences can be optimized on consideration of the construction details of the flow machine.

For optimizing the fluid flow and/or for the further reduction of the damaging swells and turbulences in the fluid the flow guiding element can likewise also be a multipart flow guiding element, in particular a multi-part flow guiding element including at least two radially interleaved part elements, especially two part elements concentric to one another. Wherein naturally in a different embodiment the flow guiding element alternatively or at the same time can be a multi-part flow guiding element, in particular a multi-part flow guiding element including at least two mutually axially offset part elements, and especially two axial part elements arranged alongside one another.

For securing the flow guiding element in accordance with the invention in the interior of the housing a whole series of different possibilities are available to the person of ordinary skill in the art. For example, the flow guiding element can be secured to an attachment element at the housing, wherein a plurality of attachment elements can preferably be provided. The attachment element can specifically be any kind of suitable attachment element, e.g. a web or a rod simultaneously welded or screwed to the housing and to the flow guiding element, which web or rod is suitably formed and aligned with respect to the fluid flow in the flow machine, or can be any other kind of suitable attachment means known to the person of ordinary skill in the art. In this connection the attachment element is arranged parallel to the axis of rotation of the flow machine and/or the attachment element can be arranged perpendicular to the axis of rotation and/or the attachment element can naturally also be arranged transverse to the axis of rotation. In this connection, the person of ordinary skill in the art knows which kind of attachment he can advantageously select in dependence on the specific constructive design of the flow machine.

For an ideal guiding of the fluid flow within the flow machine and/or for the reduction of damaging swells or turbulences in the fluid and/or for the improved distribution of the forces or moments acting in the operating state, a guide vane can be provided in a manner known per se at the flow guiding element in a preferred embodiment, wherein additionally or alternatively naturally a wall guide vane can also be provided at the inner wall of the rotor space. In this connection the guide vane can extend at a predetermined radial angle of inclination from the flow guiding element in the radial direction towards the inner wall of the rotor space and/or the guide vane can also extend at a predetermined axial angle of inclination to the flow guiding element in the axial direction towards the inner wall of the rotor space. All of these are measures which are well known to the person of ordinary skill in the art from the prior art.

It is naturally understood that the flow machine in accordance with the invention can specifically also be a double flow machine, in particular a double suction pump or a double flow turbine and/or a multi-stage flow machine having a plurality of rotors. In principle a flow machine of the present invention can be any arbitrary flow machine in which a flow guiding element in accordance with the invention can be advantageously used.

Moreover, the invention also relates to a flow guiding element for a flow machine of the present invention, wherein a flow guiding element in accordance with the information in a specific case can be designed in accordance with an embodiment illustrated in this application or in accordance with suitable combinations thereof.

BRIEF DESCRIPTION OF THE DRAWINGS

In the following the invention will be explained in detail with reference to the drawing. There is shown in schematic illustration.

DETAILED DESCRIPTION OF THE EMBODIMENTS

Figure 1:
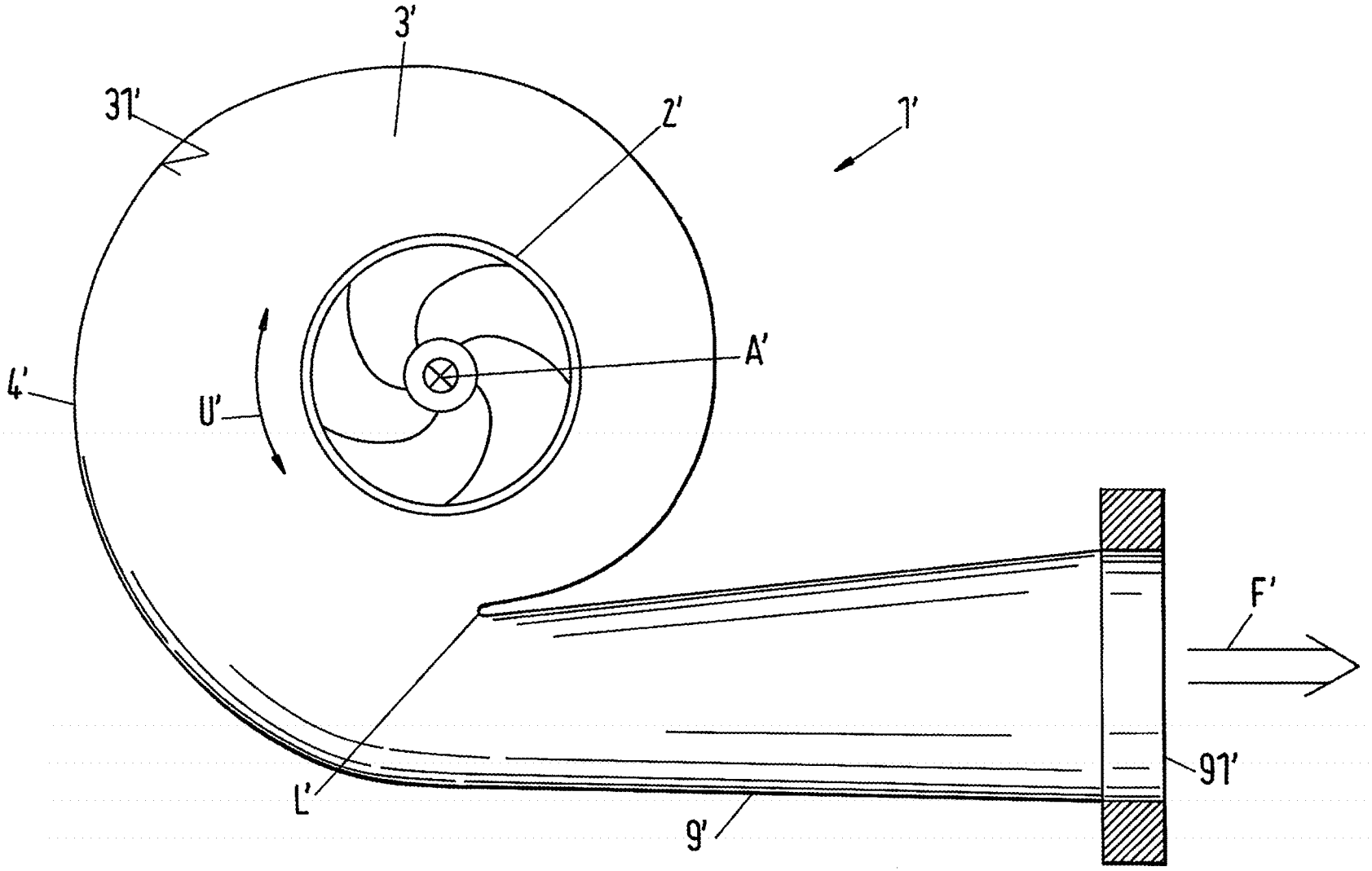
FIG. 1 is a rotary pump known from the state of the art.

For a better understanding of the delimitation of the invention with respect to the state of the art, FIG. 1 relates to a known rotary pump which was described in detail in the introduction and for this reason does not have to be discussed in this context anymore.

Figure 1A:
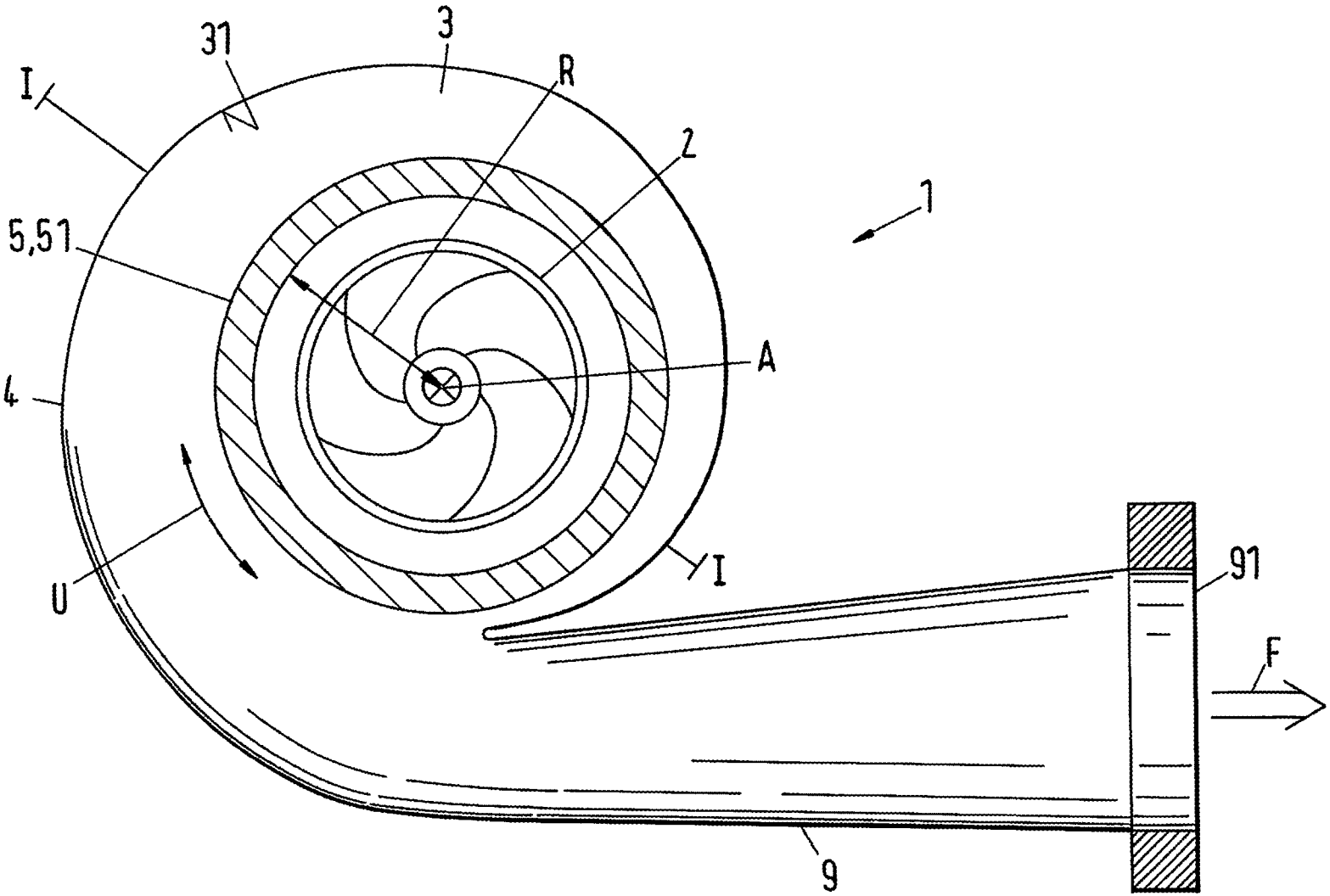
FIG. 1*a* is a first specific embodiment of a flow machine in the form of a rotary pump in accordance with the invention.
Figure 1B:
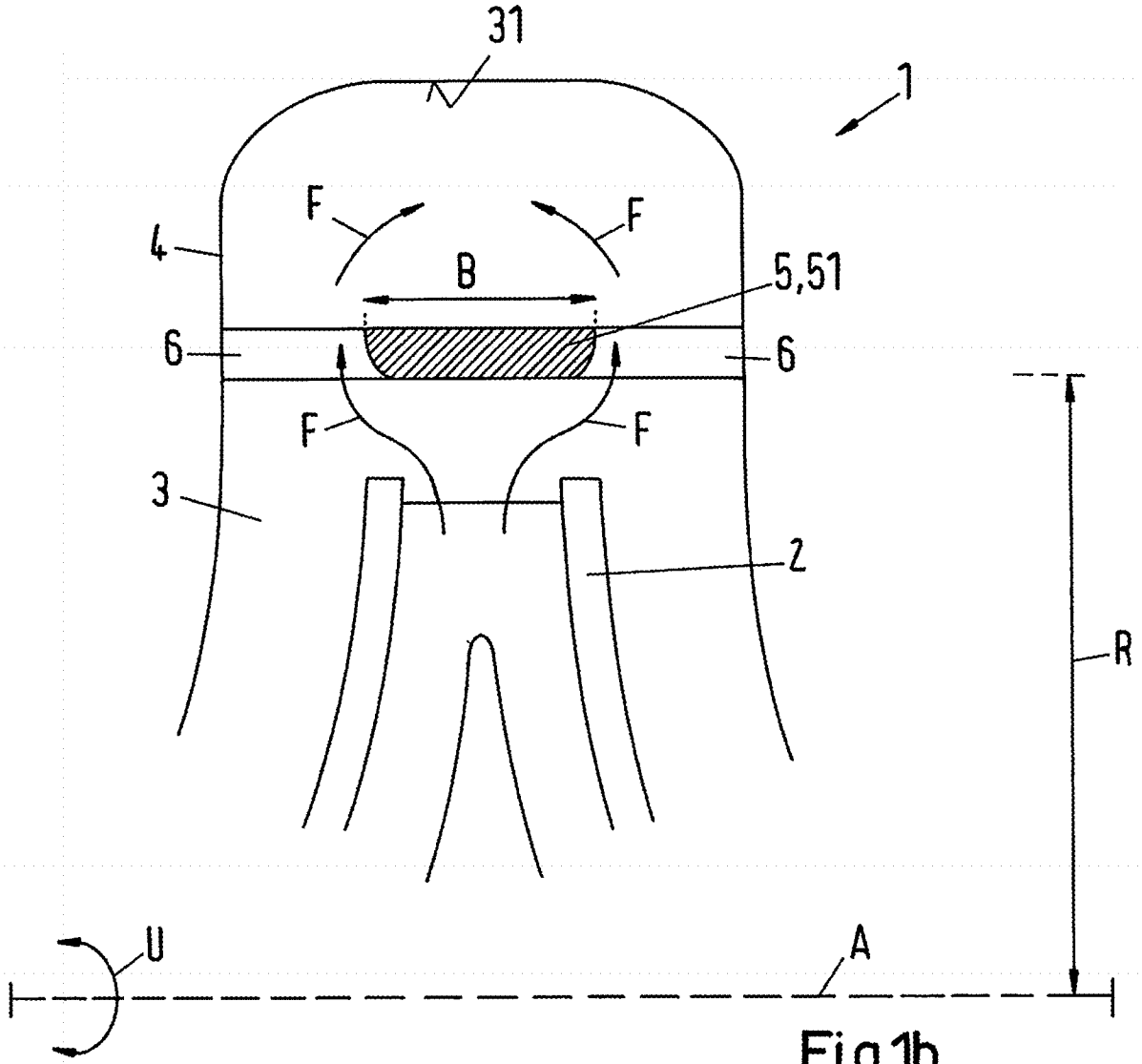
FIG. 1*b* is a section along the sectional line I-I in accordance with FIG. 1*a;*

By way of example a first specific embodiment of a flow machine in accordance with the invention in the form of a rotary pump will be explained in detail in the following with reference to FIG. 1*a* and FIG. 1*b*, with FIG. 1*b* showing a section along a sectional line I-I in accordance with FIG. 1*a*.

The flow machine in accordance with the invention of FIG. 1*a* and of FIG. 1*b*, which in the following will be referred to totally using the reference numeral 1, in the present specific embodiment is a rotary pump including a rotor 2 which is rotatably arranged about an axis of rotation A in a rotor space 3 of a housing 4 of the flow machine 1. In this connection, for energy exchange between a flow energy of a fluid F flowing through the pump and a mechanical rotational energy, the fluid F can be supplied to the housing 4 of the flow machine 1, via the rotor 2 in the region of the rotor hub via an inlet passage not explicitly illustrated for reasons of clarity, in such a way that it can be brought into flowing contact with the rotor 2 for the energy exchange and can be led out of the housing 4 of the flow machine 1 again via the outlet passage 9 and the outlet 91 for further use. In accordance with the invention a flow guiding element 5, 51, 52 running about the axis of rotation A in a peripheral direction U of the rotor 2 is provided in the rotor space 3 between an inner wall 31 of the rotor space 3 and the rotor 2 in such a way that the rotor 2 is surrounded by the flow guiding element 5, 51, 52 over a predetermined axial width B.

With regard to the specific embodiment of a flow machine 1 in accordance with the invention according to FIG. 1*a* and/or FIG. 1*b* the flow guiding element 5, 51, 52 is formed in the shape of a substantially cylindrical flow ring 51 of a width B at a radial spacing R from the axis of rotation A in the peripheral direction U around the rotor 2, wherein, in the present embodiment, the flow ring 51 has a width B which approximately corresponds to the axial width of the rotor 2. The cross-section of the flow guiding element 5, 51, 52 in this connection is substantially of rectangular design, wherein, however, the width B of the flow guiding element 5, 51, 52 can slightly reduce in the radial direction towards the rotor 2, as can in particular be seen from the FIG. 1*b*, whereby the round flowing of the flow guiding element 5, 51, 52 is optimized.

Figure 1C:
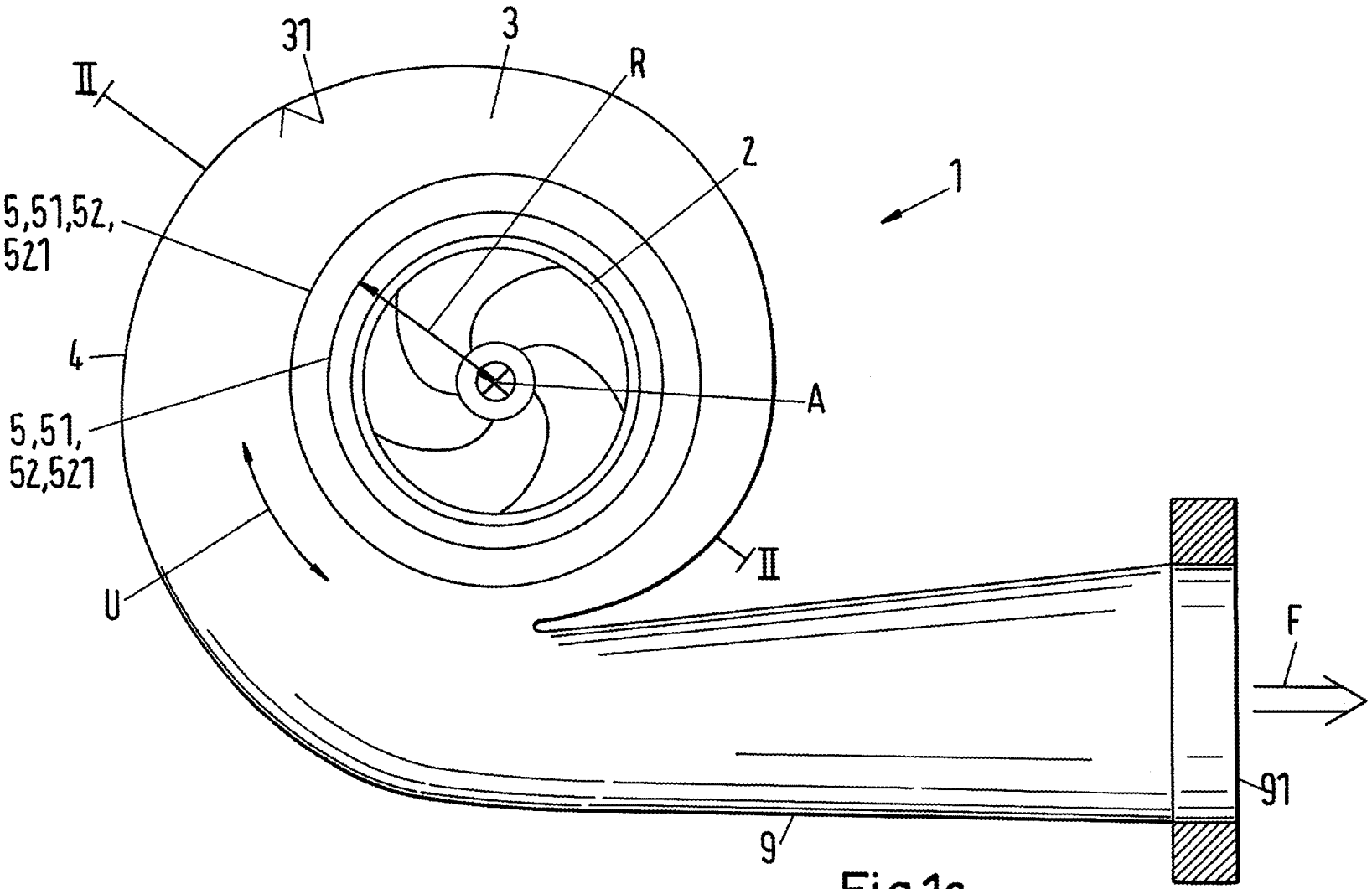
FIG. 1*c* is a second embodiment in accordance with FIG. 1*a* having a flow guiding element with two radially interleaved part elements.
Figure 1D:
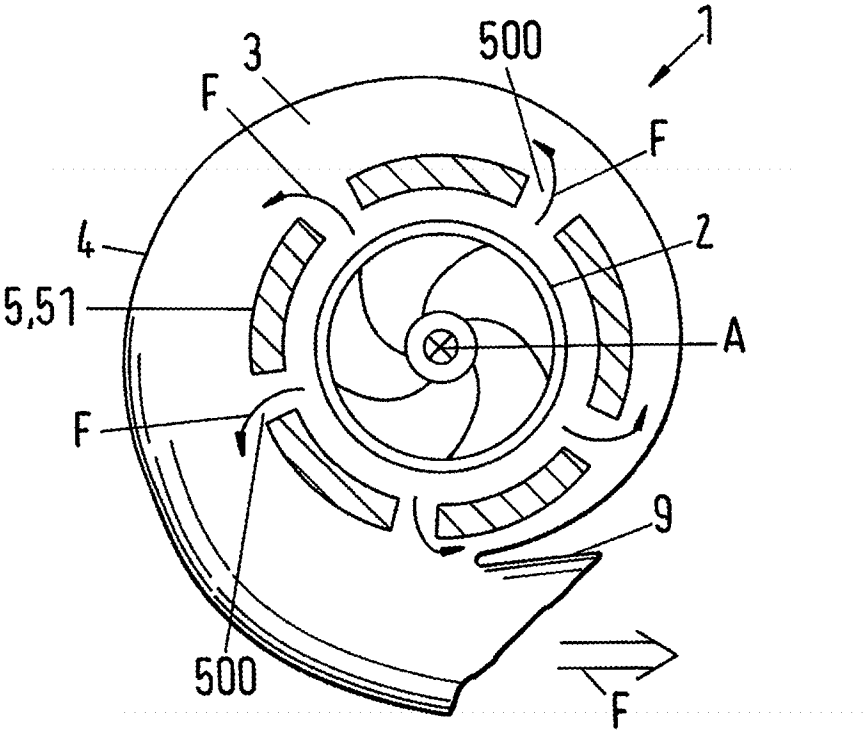
FIG. 1*d* is a third embodiment in accordance with FIG. 1*a* with a flow guiding element having radially extending through flow openings.

The FIG. 1*c* and FIG. 1*d* each show a second and third embodiment in accordance with FIG. 1*a*, wherein with reference to the FIG. 1*c* a flow machine 1 having a flow guiding element 5, 51, 52 with two radially concentrically interleaved part elements 521 is illustrated in contrast to which a third embodiment in accordance with FIG. 1*a* is shown with reference to the FIG. 1*d* in which the flow guiding element 5, 51, 52 has a plurality of radially outwardly extending through flow openings 500 which, on the one hand, improve the flow characteristics of the fluid F in the region of the rotor 2 and, on the other hand, are configured in such a way that due to the through flow openings 500 the forces acting on the rotor 2 are also optimized in the operating state.

Figure 1E:
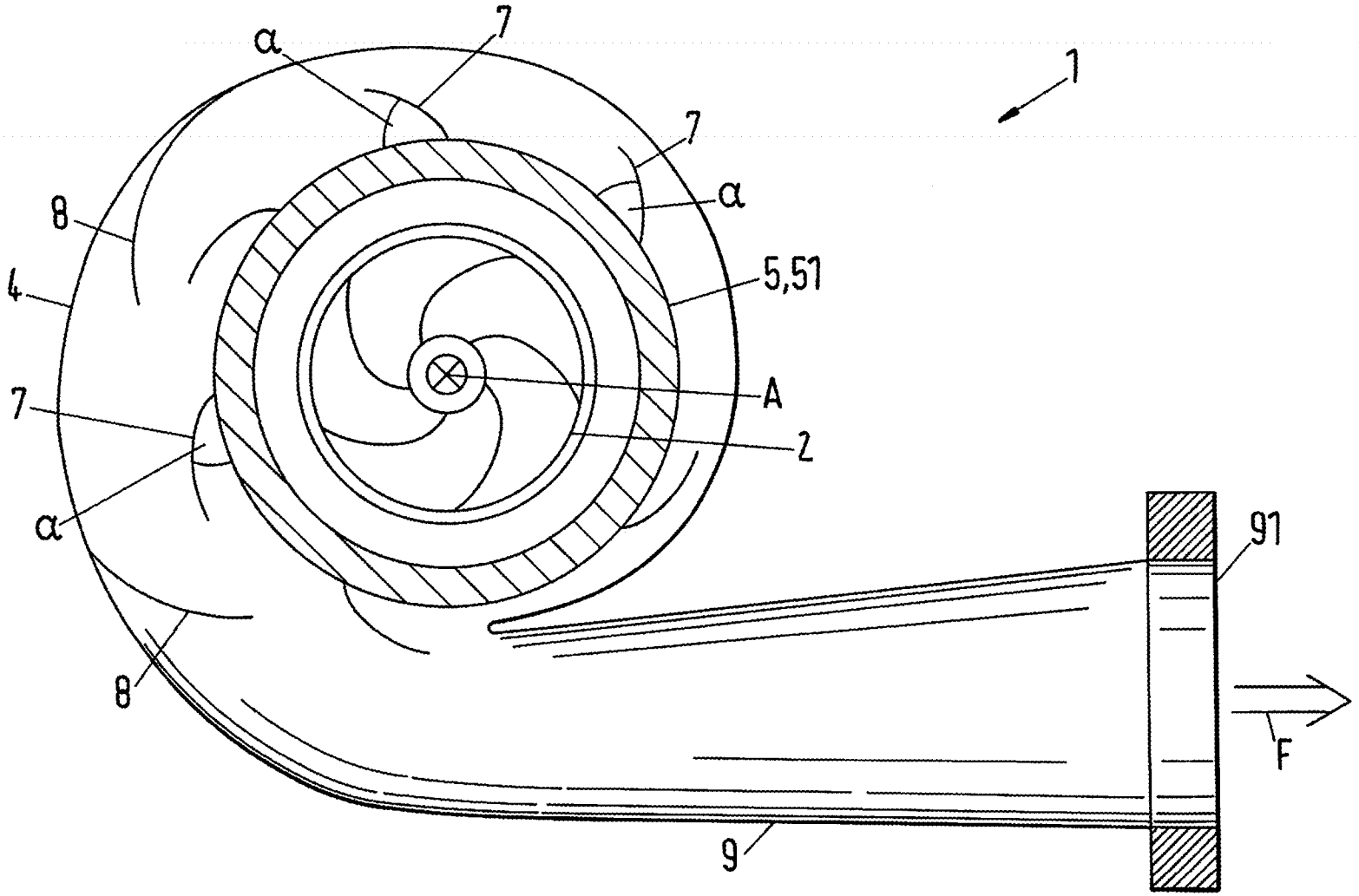
FIG. 1*e* is a third embodiment in accordance with FIG. 1*a* having guide vanes at the flow guiding element and wall guide vanes.

The FIG. 1*e* schematically shows a third embodiment of a flow machine 1 in accordance with the invention according to FIG. 1*a* having guide vanes 7 at the flow guiding element 5, 51 for the guidance of the fluid F and additionally having wall guide vanes 8 for guiding the fluid F in a manner known per se at the inner wall 31 of the rotor space 3. The guide vanes 7 at the flow guiding element 5, 51 in accordance with the invention are attached at a predetermined radial angle of inclination $\alpha$ which can be suitably set by the person of ordinary skill in the art depending on the type of application as a pump or a turbine and/or in agreement with the operating parameters required in the specific application.

Figure 1F:
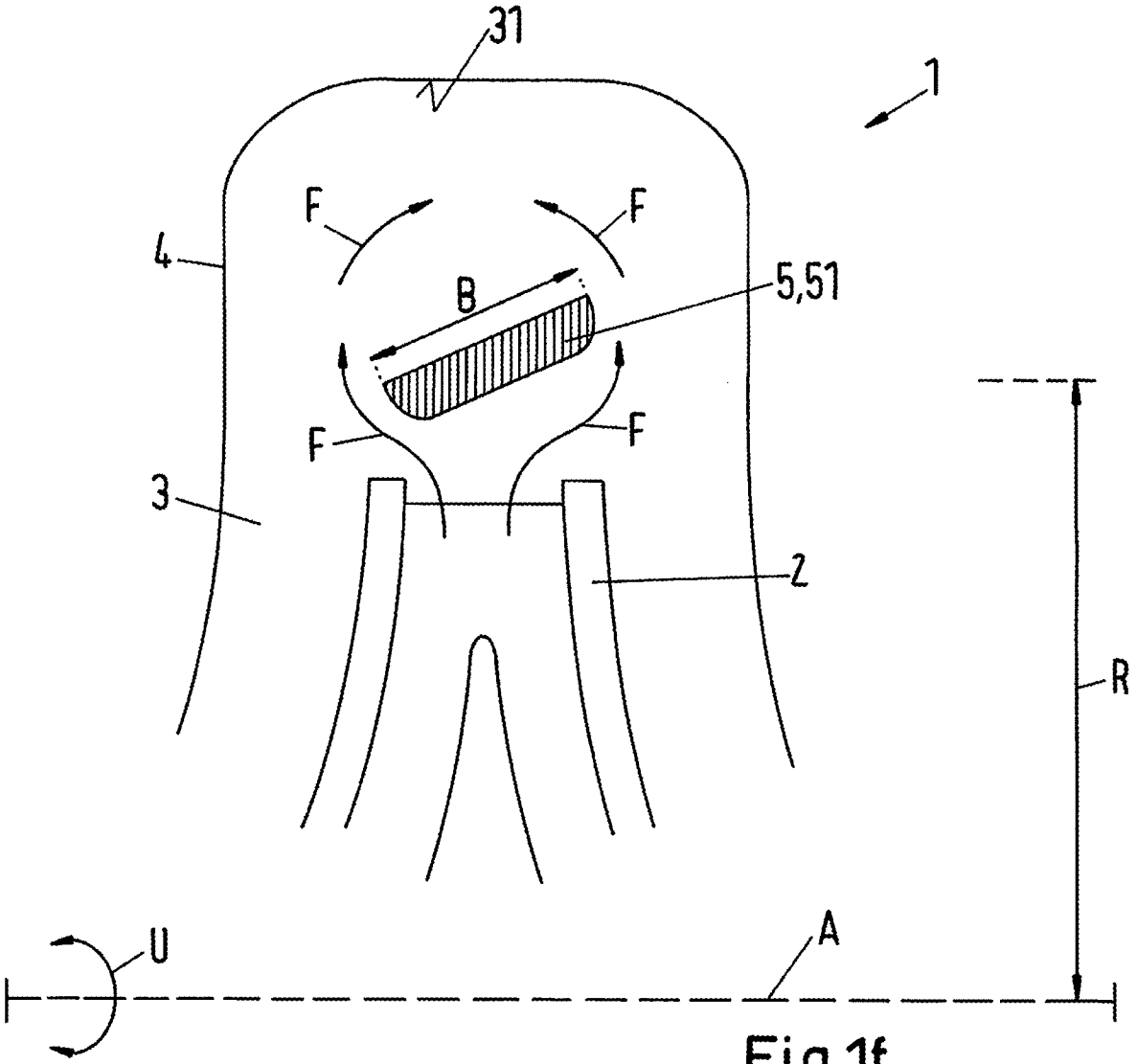
FIG. 1*f* is an embodiment in accordance with FIG. 1*a* having a fluid guiding element arranged inclined with respect to the axis of rotation.

In this connection it is naturally understood that the arrangement and/or the design of the flow guiding element 5, 51, 52 can also take place in a different manner than that exemplary illustrated in the drawing. For example, in accordance with FIG. 1*f*, the flow guiding element 5, 51, 52 can also be arranged inclined with respect to the axis of rotation A or have a roof shape, wherein the tip of the roof of the flow guiding element can also be orientated in the direction towards the axis of rotation A or also away from the axis of rotation A depending on the hydraulic requirements.

Likewise, in a different embodiment, it is also possible that the flow guiding element 5, 51, 52 is sealingly secured at a side over the entire periphery at the inner wall 31 of the rotor space 3 such that the flow guiding element 5, 51, 52 forms a half sidedly closed space with respect to the rotor space 3 or can be arranged or configured in any other suitable form.

Figure 2A:
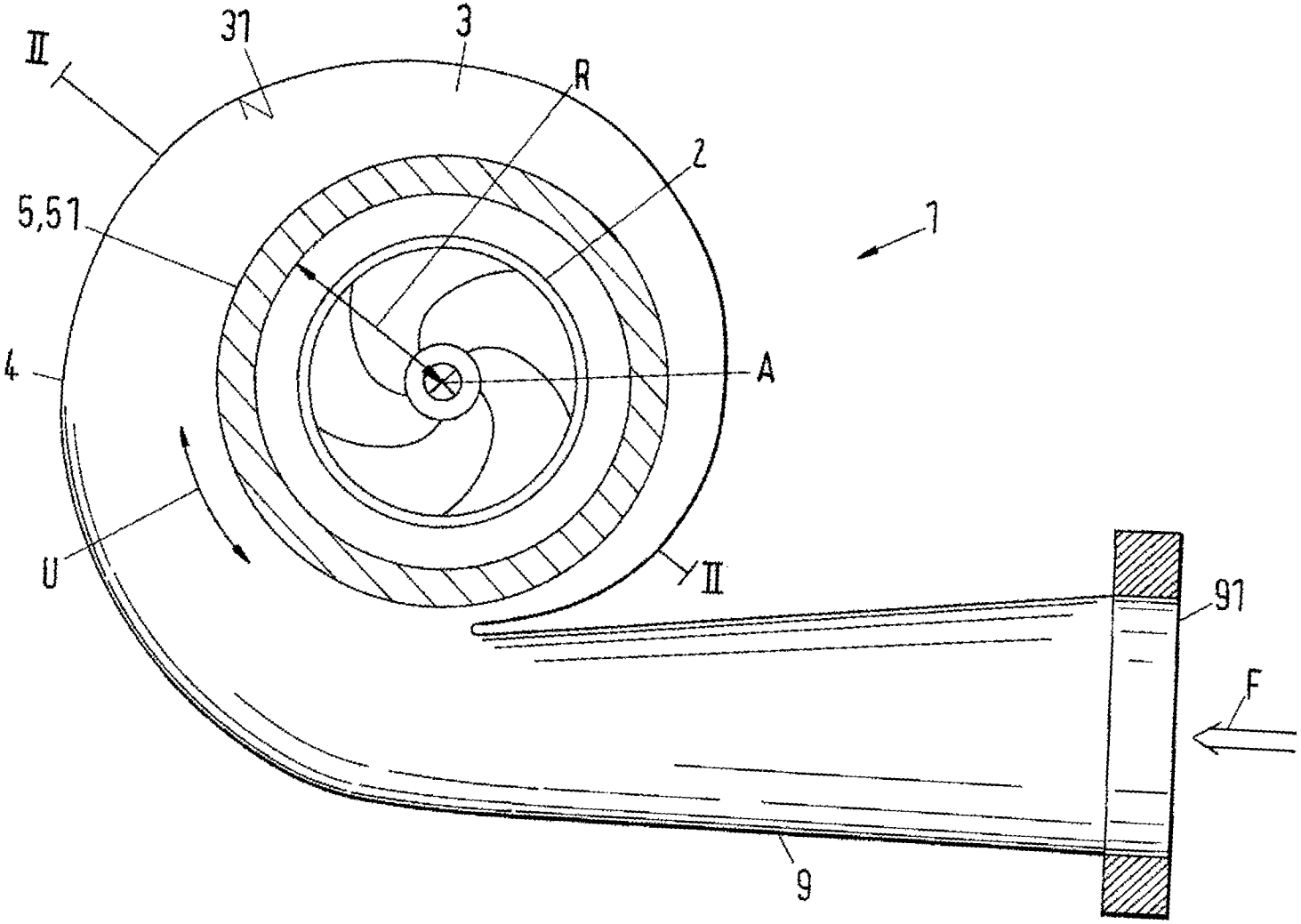
FIG. 2*a* is a different specific embodiment of a flow machine in accordance with the invention in the form of a simple turbine.
Figure 2B:
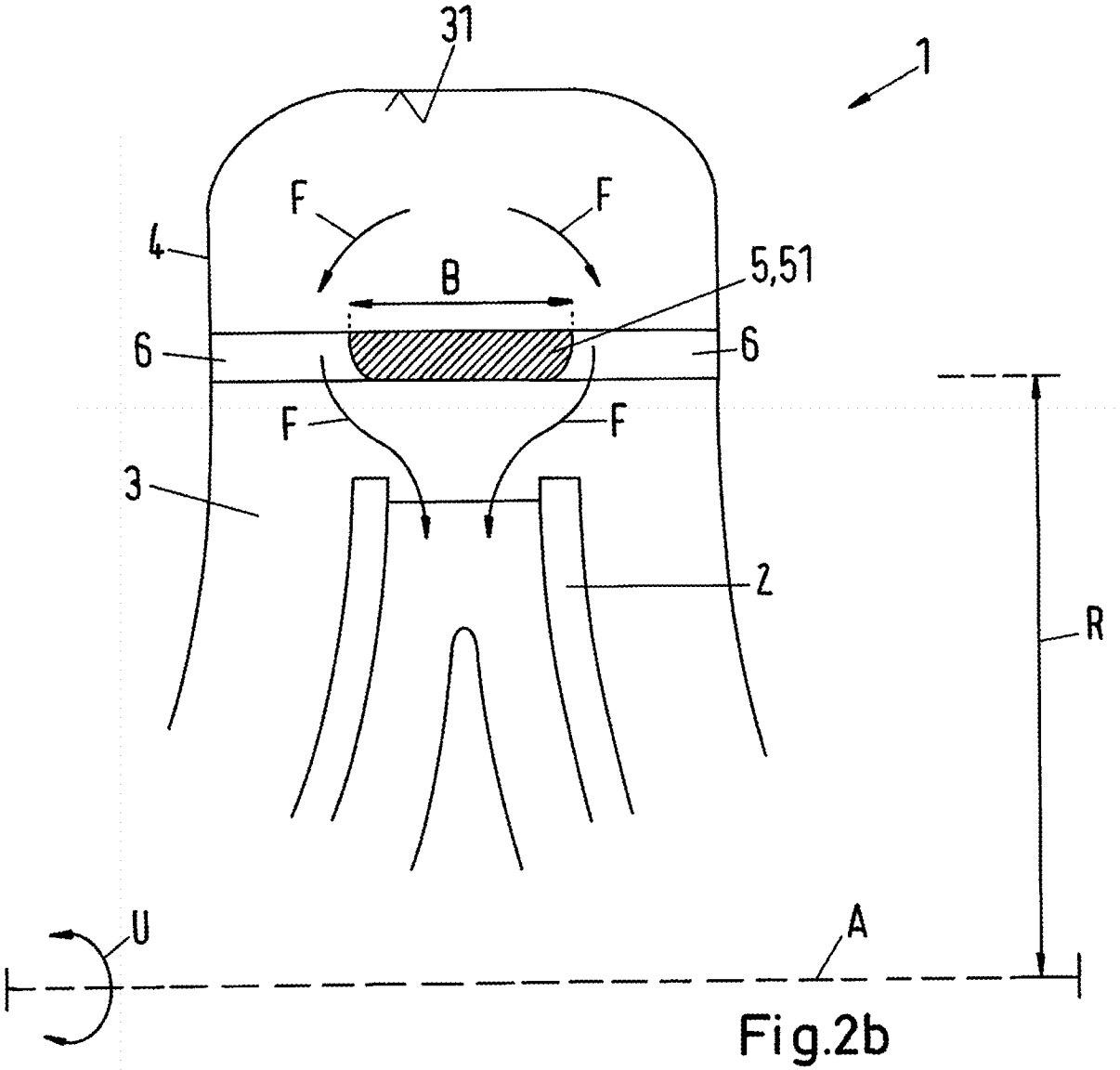
FIG. 2*b* is a section along the sectional line II-II in accordance with FIG. 2*a;*

The FIG. 2*a* and FIG. 2*b* in a schematic way show a different specific embodiment of a flow machine 1 in accordance with the invention which in the present case is realized in the form of a simple turbine. In this connection the FIG. 2*b* shows a section along the sectional line II-II in accordance with FIG. 2*a* for reasons of emphasis.

The principle underlying the assembly of the turbine in accordance with FIG. 2*a* and FIG. 2*b* in this connection is substantially identical to that of the pump in accordance with FIG. 1*a* and FIG. 1*b*. The pump of the FIG. 1*a* and/or of FIG. 1*b* is actually simply made to a turbine in that in accordance with FIG. 2*a* and/or FIG. 2*b* the fluid F is now guided to the flow machine 1 via the outlet passage 9 and/or the outlet 9 referred to as a connector of the pump and is guided away for the further use via an inlet passage of the pump referred to as a connector. Expressed in a more simple manner, the pump in accordance with FIG. 1*a* and/or FIG. 1*b* is made to a turbine in accordance with FIGS. 2*a* and/or 2*b* in that the direction of the flow of the fluid F through the flow machine 1 is reversed. Such flow machines 1 can e.g. be advantageously used in pump storage power plants, since then with one and the same flow machine 1, the water can initially be pumped for the storage of excess electrical energy into a higher lying reservoir during the pump operation and later the same flow machine 1 can simply be flowed through with water in a reverse manner and therefore work as a turbine such that the electrical energy is reconverted into electrical energy.

Figure 3A:
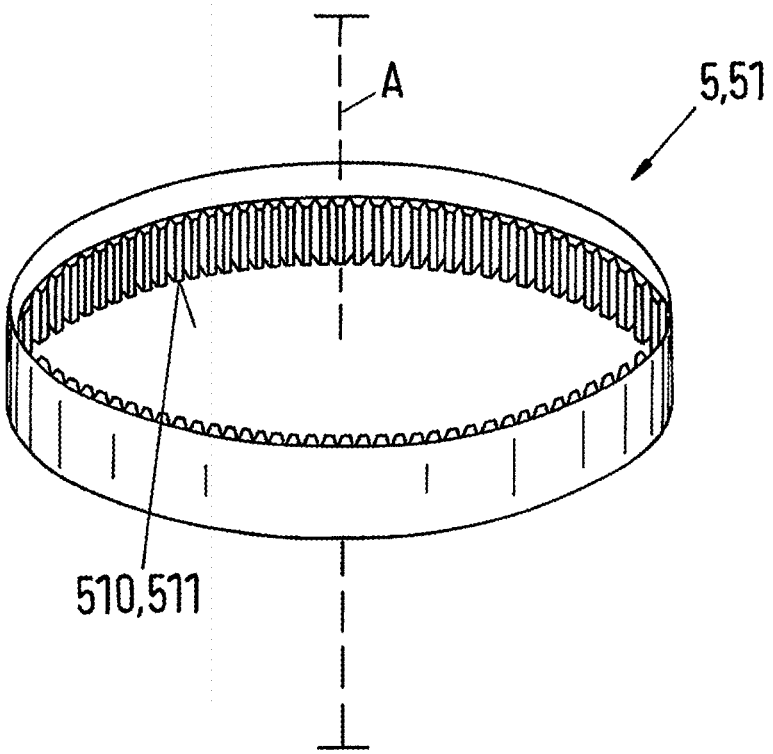
FIG. 3*a* is a flow guiding element in accordance with the invention having an axially extending structured surface.
Figure 3B:
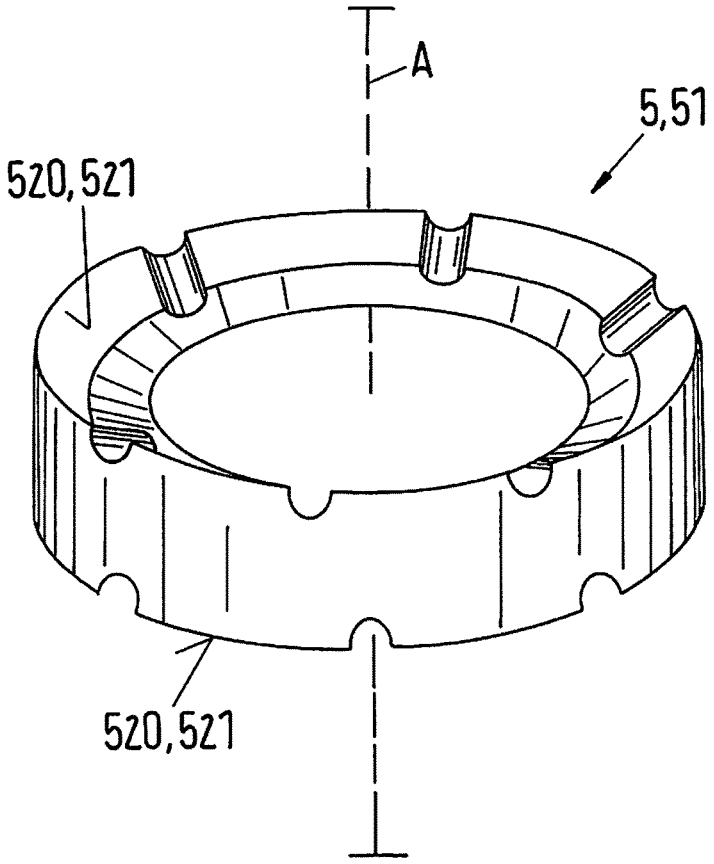
FIG. 3*b* is a different flow guiding element in accordance with the invention having a radially extending structured surface.

The FIG. 3*a* and FIG. 3*b* in an exemplary manner in a schematic illustration finally show two further variants of embodiments of specific embodiments of flow guiding elements 5, 51 and in accordance with the invention.

FIG. 3*a* shows a flow guiding element 5, 51 in accordance with the invention having two axially extending structured surfaces which form periodic longitudinal passages at an inner surface of the flow guiding element 5, 51 in the peripheral direction U. In contrast to this, FIG. 3*b* shows a different flow guiding element 5, 51 in accordance with the invention with a radially extending periodically structured surface at the two axial bounding surfaces of the flow guiding element 5, 51. It is understood that such structures which all optimize the fluid flow past the flow guiding element 5, 51, 52 can also be suitably provided at all other embodiments in accordance with the invention. In this connection it lies within the skill of the person of ordinary skill in the art to find a corresponding ideal formation of structure at the flow guiding element 5, 51, 52 in the specific case.

It is understood that all embodiments of the invention described in the frame work of this application are to be understood only by way of example and/or exemplary and the invention in particular but not only encompasses all suitable combinations of described embodiments just like simple further developments which the person of ordinary skill in the art recognizes without further ado due to its practical experience.

The invention claimed is:

1. A flow guiding element for a pump, comprising:

a body element extending about an axis of rotation in a peripheral direction of a rotor, and being disposed in a rotor space between an inner wall of the housing and the rotor such that the rotor is surrounded by the body element in a region of an inlet lip, and the body element has a predetermined axial width approximately corresponding to an axial width of the rotor, and, in operation, the flowing fluid impinges the flow guiding element in a radially oriented direction relative to the axis of rotation, and the flow guiding element enables the flowing fluid to flow over two axial ends thereof.

2. A pump, comprising:

a housing defining a rotor space;

a rotor arranged about an axis of rotation in the rotor space of the housing, the housing being configured so as to enable a flowing fluid to exchange energy with the rotor and, after the energy exchange, to lead the flowing fluid out of the housing; and a flow guiding element extending about the axis of rotation in a peripheral direction of the rotor, and being disposed in the rotor space between an inner wall of the housing and the rotor such that the flow guiding element surrounds the rotor, in a region of an inlet lip, and the flow guiding element has a predetermined axial width approximately corresponding to an axial width of the rotor, and, in operation, the flowing fluid impinges the flow guiding element in a radially oriented direction relative to the axis of rotation, and the flowing guiding element enables the flowing fluid to flow over two axial ends thereof.

3. The pump in accordance with claim 2, wherein the flow guiding element is a cylindrical flow ring having the predetermined width at a radial spacing from the axis of rotation in the peripheral direction around the rotor.

4. The pump in accordance with claim 2, wherein the flow guiding element has a cross-section that is rectangular, at least section-wise, or has a droplet shape at least section-wise.

5. The pump in accordance with claim 2, wherein the flow guiding element includes a throughflow opening.

6. The pump in accordance with claim 2, wherein the flow guiding element has a surface extending in an axial direction with a structured surface.

7. The pump in accordance with claim 6, wherein the structed surface is a periodically structured interface extending in the peripheral direction.

8. The pump in accordance with claim 2, wherein the flow guiding element has a marginal surface extending in a radial direction with a structured surface.

9. The pump in accordance with claim 8, wherein the structured interface is a periodically structured surface extending in the peripheral direction.

10. The pump in accordance with claim 2, wherein the flow guiding element is multipart flow guiding element including at least two radially interleaved part elements concentric to one another.

11. The pump in accordance with claim 2, wherein the flow guiding element is a multipart flow guiding element including at least two mutually axially offset axial part elements arranged alongside one another.

12. The pump in accordance with claim 2, wherein the flow guiding element is secured to an attachment mechanism at the housing, the attachment mechanism being arranged parallel to the axis of rotation.

13. The pump in accordance with claim 2 further comprising a guide vane disposed on the flow guiding element, and being configured to guide the fluid.

14. The pump in accordance with claim 13, wherein the guide vane extends at a one of a predetermined radial angle of inclination from the flow guiding element in a radial direction towards the inner wall of the housing and at a predetermined axial angle of inclination to the flow guiding element in the axial direction towards the inner wall of the rotor space.

15. The pump in accordance with claim 2, wherein the pump is a double pump.

16. The pump in accordance with claim 2, wherein the flow guiding element has a periodically structured surface extending in the peripheral direction.

17. The pump in accordance with claim 2, wherein the flow guiding element is secured to an attachment mechanism at the housing, the attachment mechanism being arranged perpendicular to the axis of rotation.

18. The pump in accordance with claim 2, wherein the flow guiding element is secured to an attachment mechanism at the housing, the attachment mechanism being arranged transverse to the axis of rotation.

19. The pump in accordance with claim 2 further comprising a wall guide vane disposed on the inner wall of the housing, and being configured to guide the fluid.

20. The pump in accordance with claim 2, wherein the pump is a multistage pump having a plurality of rotors.

21. A pump, comprising:

a housing defining a rotor space;

a rotor arranged about an axis of rotation in the rotor space of the housing, the housing being configured so as to enable a flowing fluid to exchange energy with the rotor and, after the energy exchange, to lead the flowing fluid out of the housing; and a flow guiding element extending about the axis of rotation in a peripheral direction of the rotor, and being disposed in the rotor space between an inner wall of the housing and the rotor such that the flow guiding element surrounds the rotor in a region of an inlet lip, and the flow guiding element has a predetermined axial width and, in operation, the flowing fluid impinges the flow guiding element in a radially oriented direction relative to the axis of rotation, and the flow guiding element enables the flowing fluid to flow over at least one axial end thereof, the flow guiding element being a cylindrical flow ring having the predetermined width, approximately corresponding to an axial width of the rotor, at a radial spacing from the axis of rotation in the peripheral direction around the rotor, and the predetermined width of the flow guiding element reducing in a radial direction towards the rotor.

* * * * *